US008151808B2

(12) United States Patent
Tu

(10) Patent No.: US 8,151,808 B2
(45) Date of Patent: Apr. 10, 2012

(54) ELASTIC HAIR CLIP

(76) Inventor: Jui-Ming Tu, Tainan (TW)

( * ) Notice: Subject to any disclaimer, the term of this patent is extended or adjusted under 35 U.S.C. 154(b) by 252 days.

(21) Appl. No.: 12/511,923

(22) Filed: Jul. 29, 2009

(65) Prior Publication Data

US 2011/0023906 A1 Feb. 3, 2011

(51) Int. Cl.
*A45D 8/22* (2006.01)

(52) U.S. Cl. ..... 132/278; 132/276; 24/530; 24/562; 24/563

(58) Field of Classification Search ..... 132/273, 132/275–281, 283–284, 58; 24/530, 562–563, 24/545–547, 556; D28/39, 42
See application file for complete search history.

(56) References Cited

U.S. PATENT DOCUMENTS 2,795,233 A * 6/1957 Zore ..... 132/276
3,081,781 A * 3/1963 Stermer ..... 132/273
3,860,014 A * 1/1975 Clifton ..... 132/278
3,972,094 A * 8/1976 Fuller ..... 211/85.3
3,998,233 A * 12/1976 Dorr ..... 132/279
6,966,103 B2 * 11/2005 Gould ..... 24/351
7,665,191 B2 * 2/2010 Gould ..... 24/351
2005/0056298 A1 * 3/2005 McRoberts ..... 132/276

* cited by examiner

*Primary Examiner* — Todd Manahan
*Assistant Examiner* — Jennifer Gill
(74) *Attorney, Agent, or Firm* — J.C. Patents

(57) ABSTRACT

An elastic hair clip includes a clip frame composed of a first clip frame and a second clip frame, and a joint member. The first and the second clip frame respectively have one end integrally forming a joined end and another end forming an open end, respectively. A clipping strip is disposed between the first and the second clip frame, a little shorter than the first and the second clip frame and having one end formed integrally with the joined end of the first and the second clip frame. When the hair clip is used, the open ends of the first and the second clip frame are combined together by the joint member to make the first and the second clip frame properly curved for clipping hair with the help of the clipping strip.

12 Claims, 7 Drawing Sheets

ELASTIC HAIR CLIP

BACKGROUND OF THE INVENTION

1. Field of the Invention

This invention relates to an elastic hair clip, particularly to one made of plastic with high elasticity, or called a waterdrop-shaped hair clip. When the hair clip is not in use, the open ends of a first clip frame and a second clip frame of a main clip frame are separated from each other. To use the hair clip, the open ends of the first and the second clip frame are combined together by means of a joint member to make the first and the second clip frame properly curved therebetween and formed with elasticity. Thus, the clip frame cooperating with a clipping strip can elastically clip hair.

2. Description of the Prior Art

There are many conventional hair clips disclosed in Taiwan patents, such as No. 218961, titled "Integrally Formed Hair Clip", No. 224210, titled "Integrally Formed Wave Hair Clip", No. 228084, titled "Improved Structure Of a Hair Clip", No. 275198, titled "Elastic Hair Clip able to be used as a comb", No. 294019, titled "Improved Structure Of an Elastic Hair Clip", No. 308013, titled "Improved Structure Of a Hair Clip", No. 324910, titled "Pivotal Structure Of a Hair Clip", No. 346794, titled "Improved Structure Of an Elastic Hair Clip (1)", No. 521599, titled "Integral Structure Of a Hair Clip", No. M249539, titled "Elastic Hair Clip Able To Prevent Slipping Off" and No. M250585, titled "Elastic Hair Clip Able To Be Used As a Comb". All the conventional hair clips mentioned above are elastic hair clips and so-called waterdrop-shaped hair clips, and respectively provided with a main clip frame and a clipping strip. The main clip frame is composed of a first clip frame and a second clip frame and formed with a jointed end and an open end between the first and the second clip frame. The open ends of the first and the second clip frame are respectively bored with a rivet hole for a rivet to be riveted therein for combining the two open ends together to form a second jointed end, thus finishing making up an elastic hair clip.

As mentioned above, the conventional hair clips respectively have the open ends of the first and the second clip frame combined together by a rivet, letting two opposite ends of the first and the second clip frame respectively formed with a permanently-fixed jointed end to make the clip frame curved and formed with elasticity to cooperate with a clipping strip for elastically clipping hair. Therefore, such conventional elastic hair clips are all made of metallic material so that the clip frame can maintain elasticity even if the opposite ends of the first and the second clip frame are formed into permanently jointed ends. But, if the clip frame is made of plastic material and fixed in a certain shape for a long period of time, the clip frame will lose its elasticity, and this is a problem this invention wants to solve.

SUMMARY OF THE INVENTION

The objective of this invention is to offer an elastic hair clip formed integrally and made of plastic. The clip frame of the hair clip can always be kept elastic for clipping hair by using a joint member to combine the open ends of a first and a second clip frame to make the first and the second clip frame curved properly and maintain elasticity. Thus, the clip frame cooperating with a clipping strip is able to clip hair, and the clip frame can always maintain elasticity.

The elastic hair clip in the present invention includes a main clip frame composed of a first clip frame and a second clip frame, the first clip frame and the second clip frame respectively have one end integrally formed into a joined end and another end forming an open end, respectively.

The elastic hair clip is further provided with a joint member for combining the open ends of the first and the second clip frame together for making the first and the second clip frame curved properly and maintain elasticity when the hair clip is used. Thus, the clip frame with the help of a clipping strip is able to clip hair and the clip frame can be always kept elastic.

The joint member and the clip frame of the elastic hair clip of this invention can be made integrally or separately.

The clipping strip of the elastic hair clip is provided between the first and the second clip frame, a little shorter than the first and the second clip frame and having one end formed integrally with the joined end of the first and the second clip frame.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
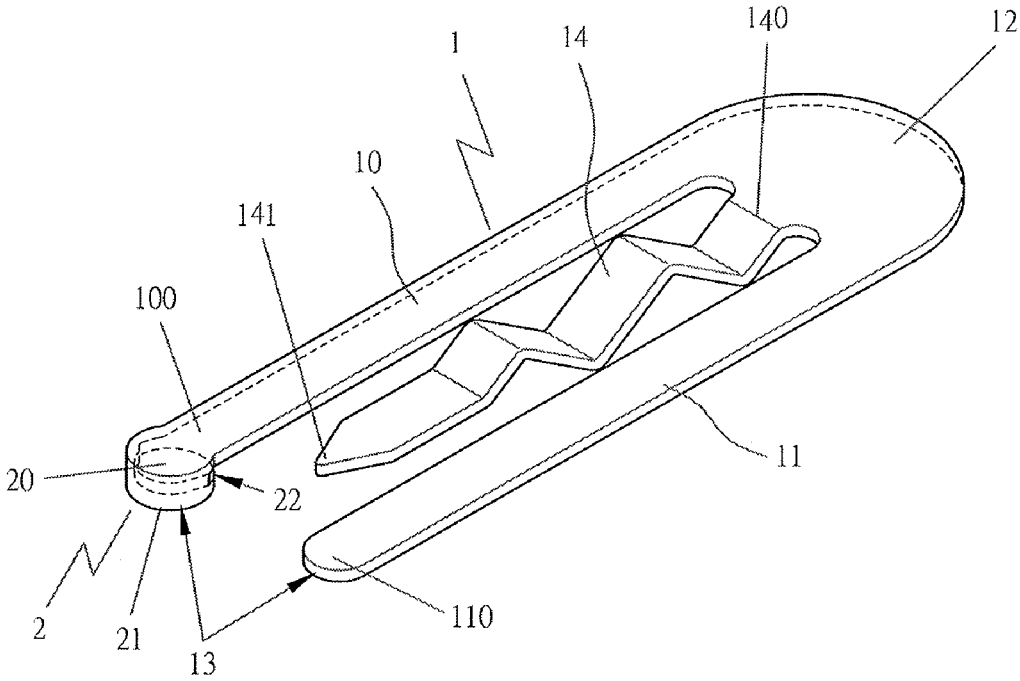
FIG. 1 is a perspective view of a first preferred embodiment of an elastic hair clip in the present invention.
Figure 2:
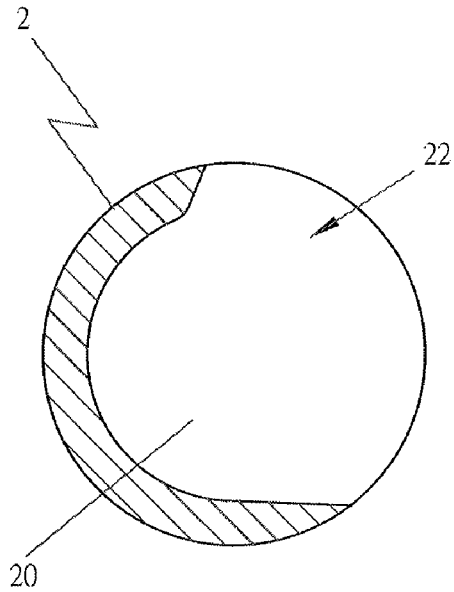
FIG. 2 is a cross-sectional view of the first preferred embodiment of a joint member of the elastic hair clip in the present invention.

A first preferred embodiment of an elastic hair clip in the present invention, as shown in FIGS. 1 to 4, includes a main clip frame 1, a joint member 2 and a clipping strip 14 combined together.

The main clip frame 1 is composed of a first clip frame 10 and a second clip frame 11 respectively having one end integrally formed into a joined end 12, and another end being an open end 13, respectively. The so-called open end means that the end 100 of the first clip frame 10 and the end 110 of the second clip frame 11 are normally separated from each other. The clipping strip 14 positioned between the first clip frame 10 and the second clip frame 11 is a little shorter than the first and the second clip frame 10 and 11 and has one end 140 integrally combined with the joined end 12 of the first and the second clip frame 10 and 11. Thus, when the open ends 13 of the first and the second clip frame 10, 11 are combined together, another end 141 of the clipping strip 14 will be positioned at another side of the main clip frame 1, as shown in FIG. 3, Thus, the main clip frame 1 and the clipping strip 14 can operate with each other to make up an elastic hair clip.

The joint member 2, as shown in FIG. 1 is integrally formed with the main clip frame 1, or after the joint member 2 and the main clip frame 1 are made separately, they are processed and combined together. In case of being made integrally, the joint member 2 can be formed integrally with the first clip frame 10 of the main clip frame 1, as shown in FIG. 1, or formed integrally with the second clip frame 11 (not shown). The joint member 2 is disposed with a groove 20 formed with a lower wall 21 and bored with an opening 22.

Figure 3:
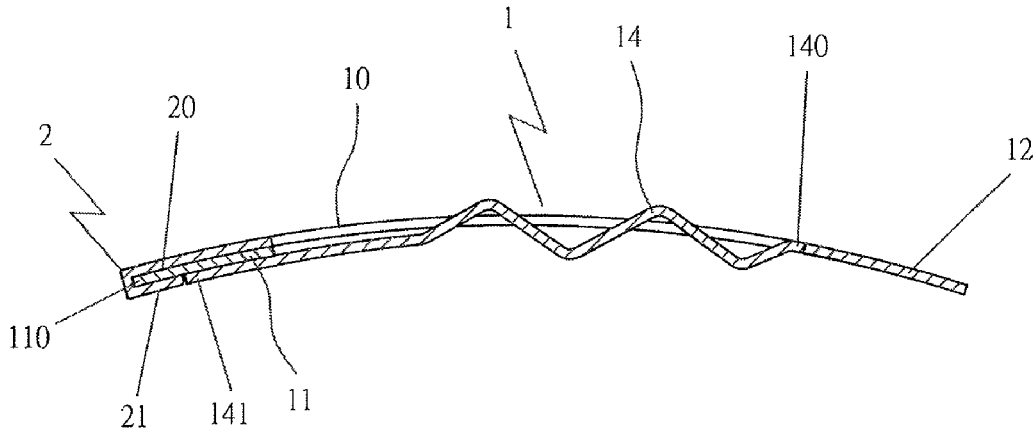
FIG. 3 is a cross-sectional view of the first preferred embodiment of an elastic hair clip in the present invention.
Figure 4:
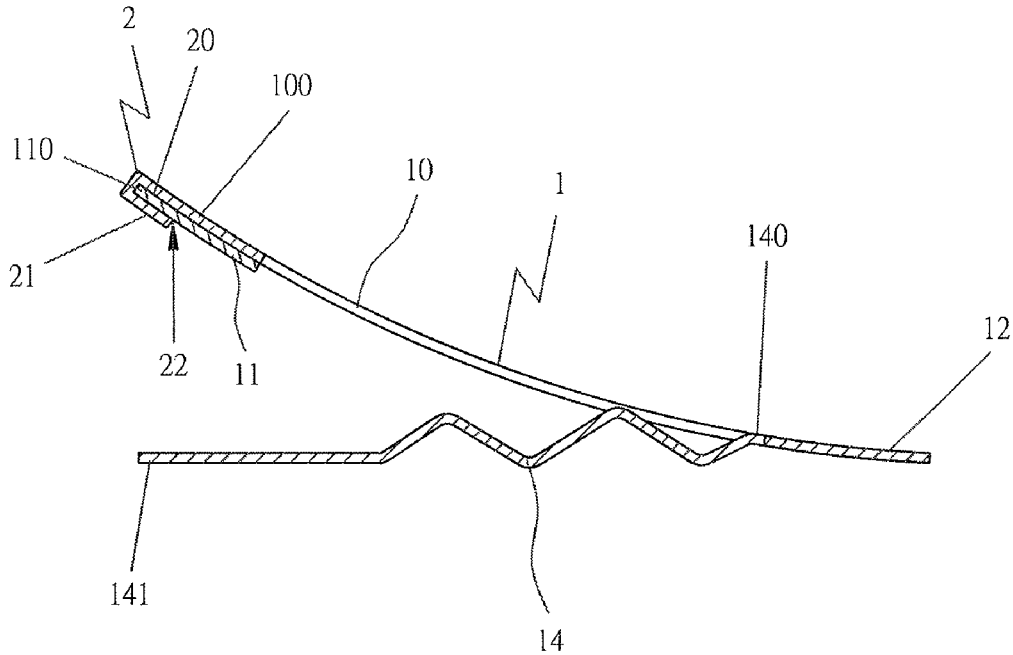
FIG. 4 is a cross-sectional view of the first preferred embodiment of an elastic hair clip before being used in the present invention.

When the end 100 of the first clip frame 10 or the end 110 of the second clip frame 11 is received in the groove 20 of the joint member 2 through the opening 22, the open ends 13 of the first and the second clip frame 10, 11 can be combined together, thus making the main clip frame 1 curved properly to form an elastic hair clip, as shown in FIG. 3. When the hair clip is to be used, only slightly press the clipping strip 14 to let the main clip frame 1 turned upward, as shown in FIG. 4, and thus between the main clip frame 1 and the clipping strip 14 will be formed a big opening by which a user's hair can be clipped therebetween. When the hair clip is not in use, the open ends of the first clip frame 10 and the second clip frame 11 will be separated from each other, and hence the two clip frames 10, 11 can always maintain elasticity, able to insure the service life of the hair clip.

Figure 5:
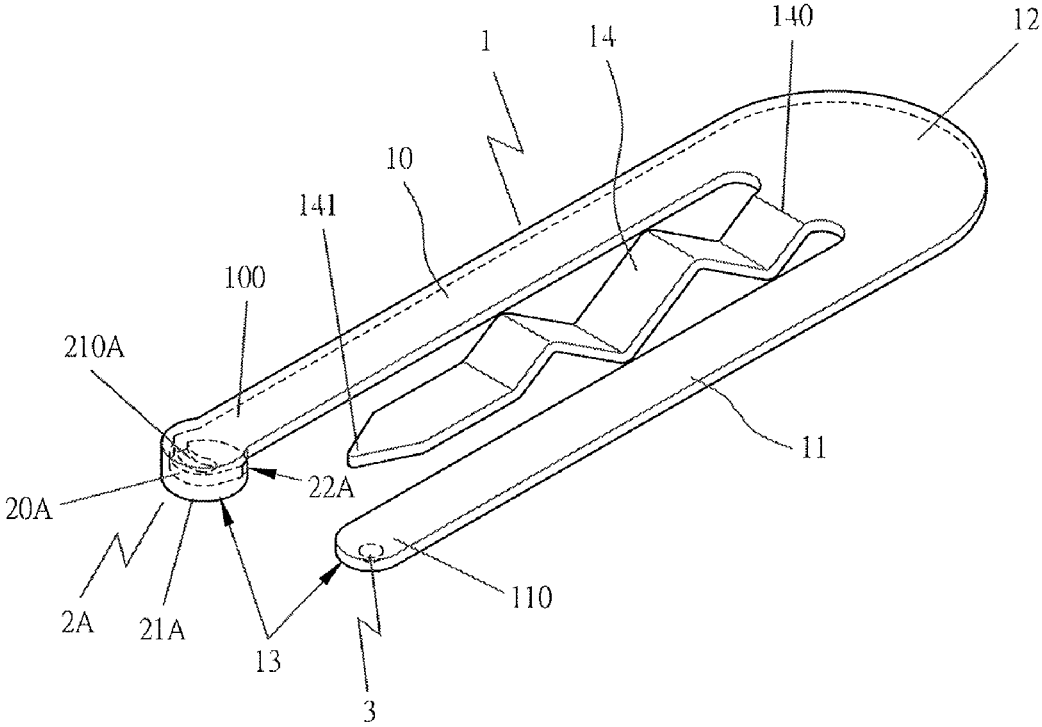
FIG. 5 is a perspective view of a second preferred embodiment of an elastic hair clip in the present invention.
Figure 6:
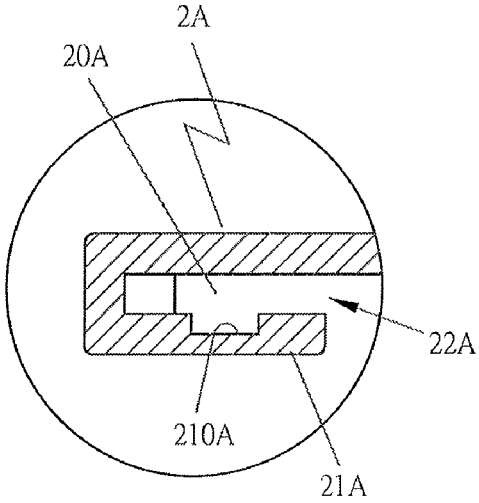
FIG. 6 is a cross-sectional view of the second preferred embodiment of an elastic hair clip in the present invention.
Figure 7:
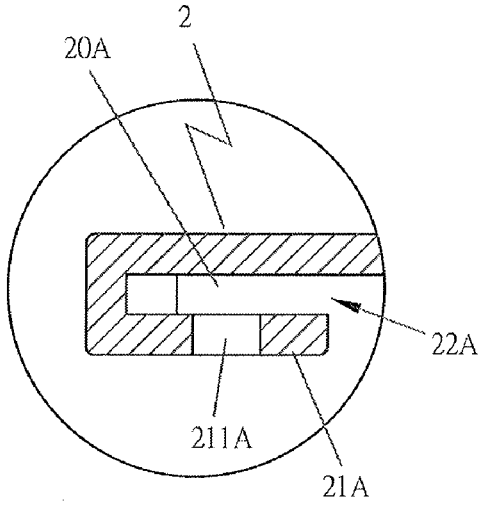
FIG. 7 is a cross-sectional view of a third preferred embodiment of an elastic hair clip in the present invention.

A second preferred embodiment of an elastic hair clip in the present invention, as shown in FIGS. 5, 6 and 7, includes a main clip frame 1 composed of a first clip frame 10 and a second clip frame 11, and a joint member 2A. The second clip frame 11 has its end 110 provided with an auxiliary joint member 3.

The joint member 2A is integrally formed with the main clip frame 1 and can be fixed with the first clip frame 10, or with the second clip frame 11 (not shown). The joint member 2A is formed with a groove 20A with a lower wall 21A having its upper side cut with a recess 210A, as shown in FIG. 6, or bored with a through insert hole 211A, as shown in FIG. 7, and the groove 20A is disposed with an opening 22A. When the open ends 13 of the first and the second clip frame 10 and 11 are to be jointed together, by means of the lower wall 21A that can properly be opened and closed elastically, the second clip frame 11 of the main clip frame 1 has its end 110 inserted and positioned in the groove 20A of the joint member 2A to let the auxiliary joint member 3 at the end 110 of the second clip frame 11 fit in the recess 201A or in the insert hole 211A. Thus, the open ends 13 of the first and the second clip frame 10, 11 can be jointed together to make the main clip frame 1 curved and form an elastic hair clip, as shown in FIG. 3. When the hair clip is not in use, the open ends 13 of the first and the second clip frame 10, 11 can be separated from each other to enable the clip frames to maintain elasticity permanently, thus insuring the service life of the hair clip.

Figure 8:
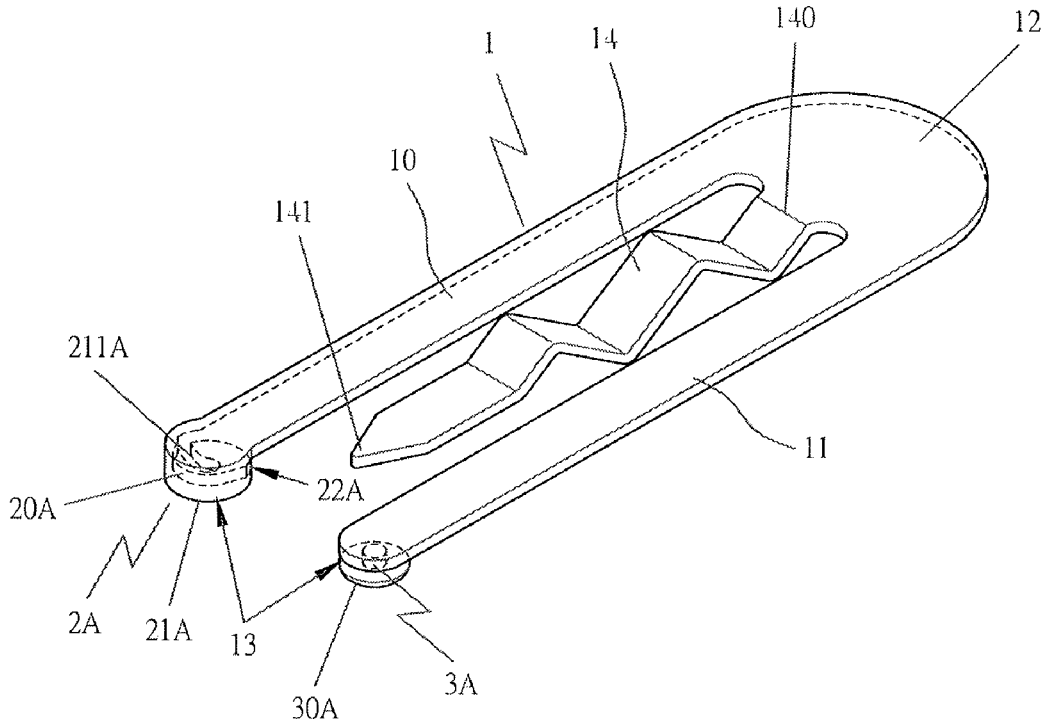
FIG. 8 is a perspective view of the third preferred embodiment of an elastic hair clip in the present invention.
Figure 9:
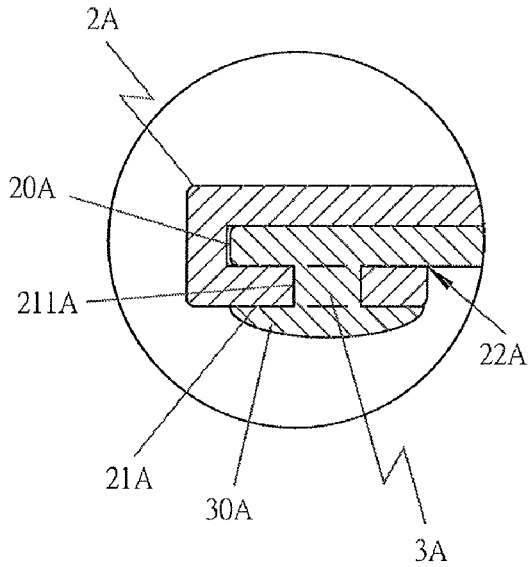
FIG. 9 is a cross-sectional view of the third preferred embodiment of an elastic hair clip in the present invention.

A third preferred embodiment of an elastic hair clip in the present invention, as shown in FIGS. 8 and 9, includes a main clip frame 1 composed of a first clip frame 10 and a second clip frame 11. The first clip frame 10 has its end 100 provided with a joint member 2A while the second clip frame 11 has its end 110 disposed with an auxiliary joint member 3A having an underside formed with an extension face 30A.

Thus, the auxiliary member 3A can be combined with the joint member 2A to have its extension face 30A resisting against the underside of the lower wall 21A of the joint member 2A for combining the open end 13 of the first and the second clip frame 10 and 11 together so as to make the main clip frame 1 curved and form an elastic hair clip. When the hair clip is not in use, the open ends of the first and the second clip frame 10 and 11 are separated, which is thus able to always maintain the elasticity of the clip frames and insure the service life of the hair clip.

Figure 10:
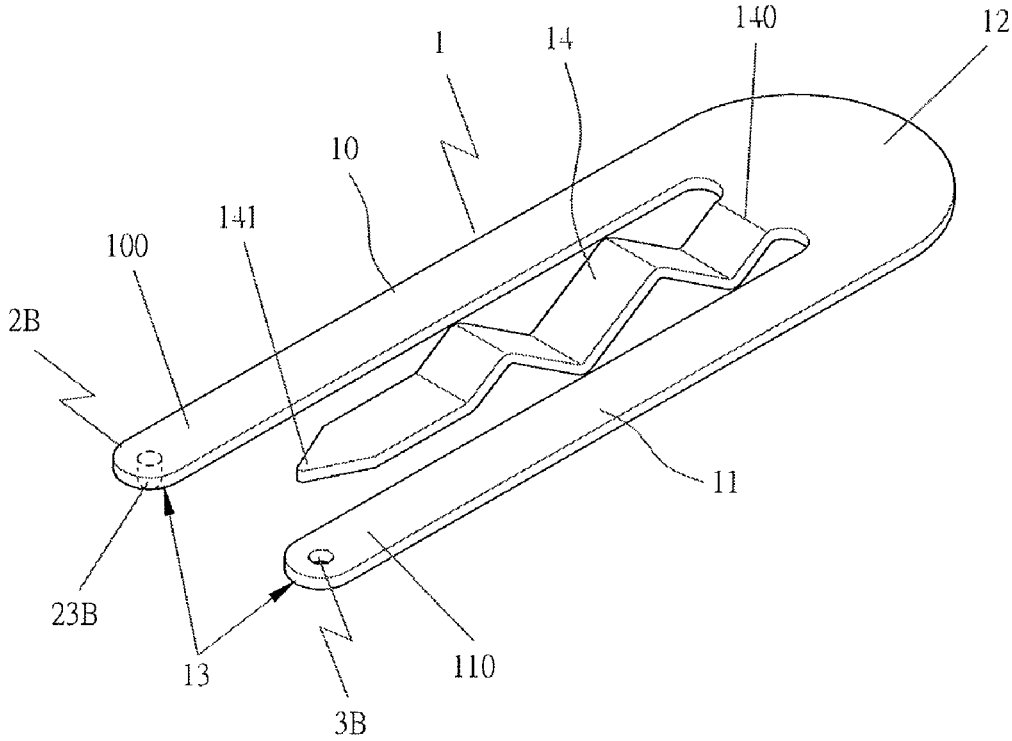
FIG. 10 is a perspective view of a fourth preferred embodiment of an elastic hair clip in the present invention.
Figure 11:
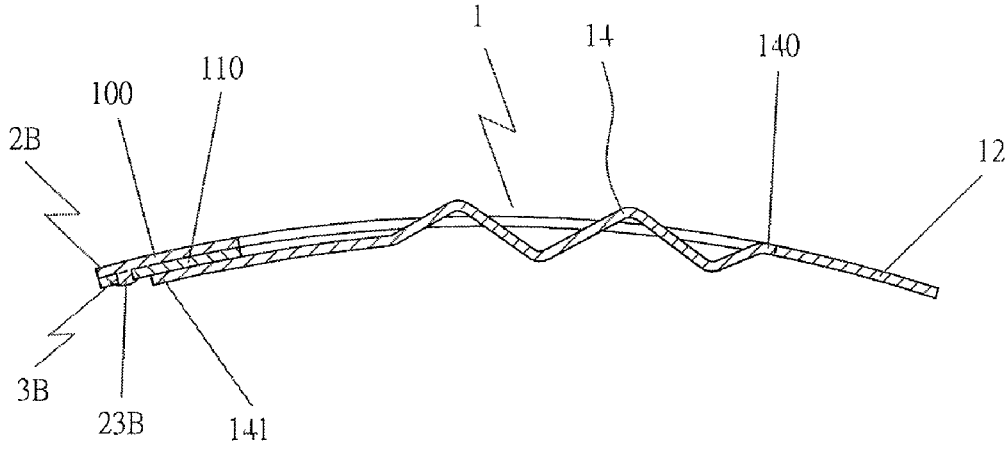
FIG. 11 is a cross-sectional view of the fourth preferred embodiment of an elastic hair clip in the present invention.

A fourth preferred embodiment of an elastic hair clip in the present invention, as shown in FIGS. 10 and 11, has almost the same structure as that described in the first preferred embodiment, except that a joint member 2B, which is a stud 23B, is fixed at the end 100 of the first clip frame 10, as shown in FIG. 10, or at the end 110 of the second clip frame 11 (not shown), and an auxiliary joint member 3B, which is a through insert hole, is provided at the end 110 of the second clip frame 11.

By so designing, the insert hole of the auxiliary joint member 3B can be fixed together with the stud 23B of the joint member 2B to combine the open ends of the first and the second clip frame 10 and 11 to make the main clip frame 1 curved and form an elastic hair clip, as shown in FIG. 3. The open ends of the first and the second clip frame 10 and 11 can easily be separated when the hair clip is not used so that the clip frames can always be kept elastic to insure the service life of the hair clip.

Figure 12:
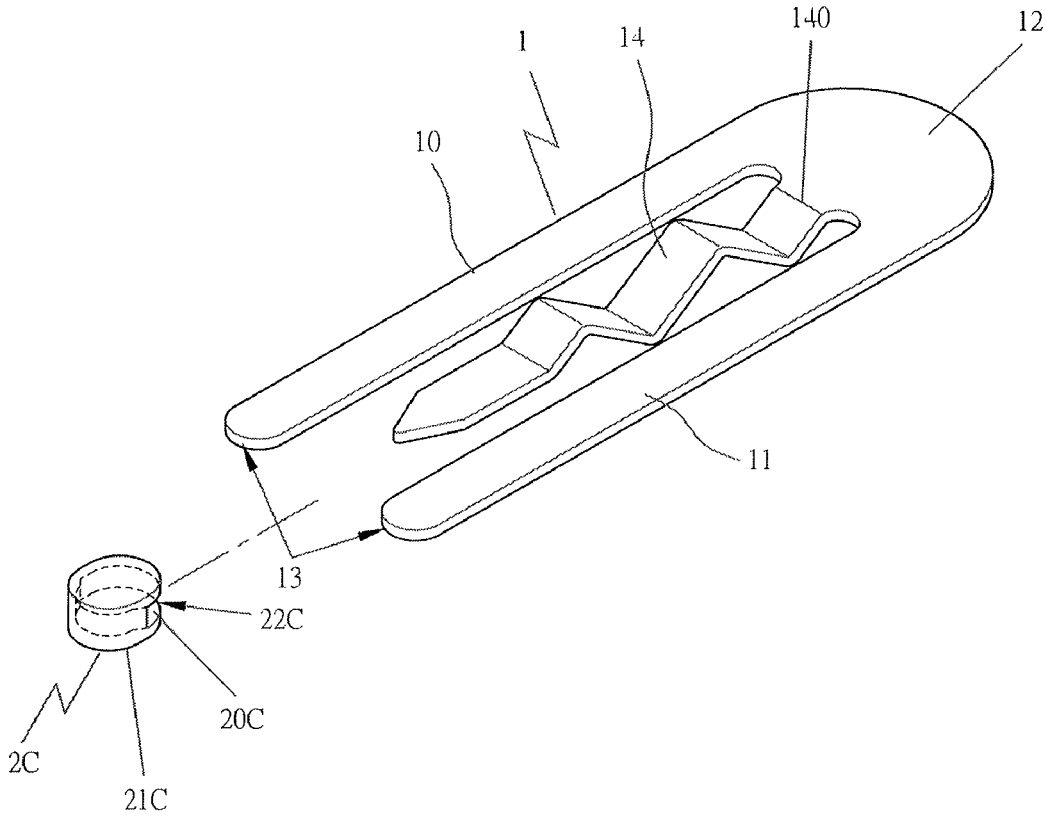
FIG. 12 is an exploded perspective view of a fifth preferred embodiment of an elastic hair clip in the present invention.

The fifth preferred embodiment of an elastic hair clip in the present invention, as shown in FIG. 12, includes a main clip frame 1 composed of a first clip frame 10 and a second clip frame 11, and a joint member 2C separated from the main clip frame 1. The joint member 2C is formed with a groove 20C with a lower wall face 21C and an opening 22C.

Thus, the joint member 2C can directly be fitted on the open ends of the first and the second clip frame 10 and 11 to combine the two open ends together, letting the main clip frame 1 become curved and maintain elasticity. When the hair clip is not in use, the open ends of the first and the second clip frame 10, 11 can be separated conveniently, which is able to always maintain the elasticity of the clip frame and prolong the service life of the hair clip.

Figure 13:
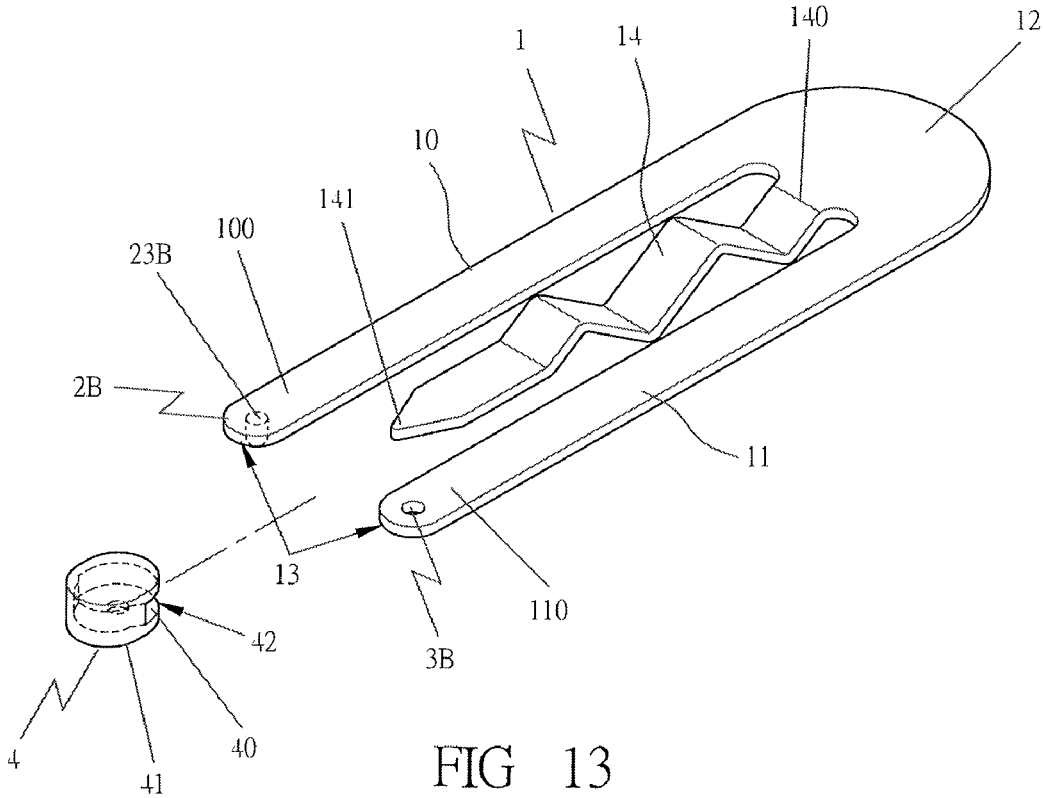
FIG. 13 is an exploded perspective view of a sixth preferred embodiment of an elastic hair clip in the present invention.
Figure 14:
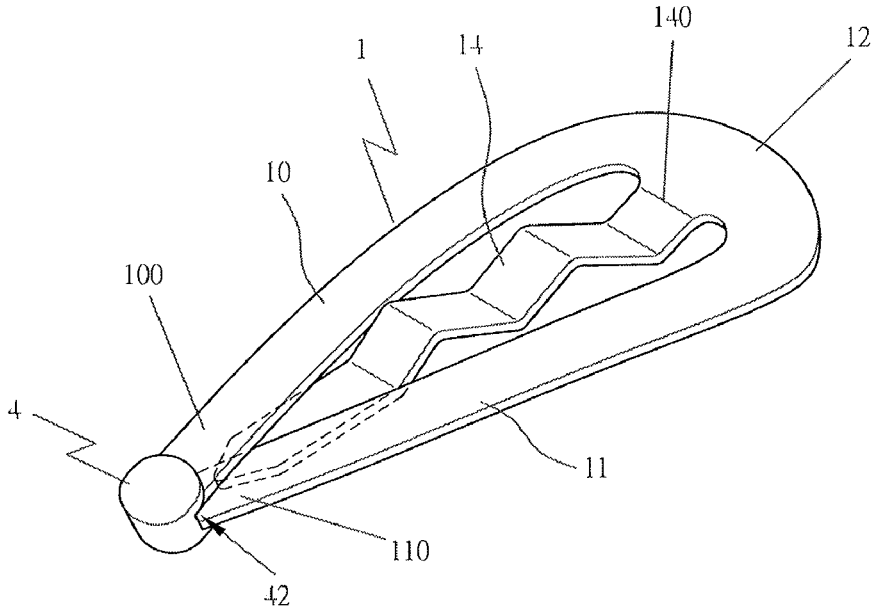
FIG. 14 is a perspective view of the fifth preferred embodiment of an elastic hair clip in the present invention.

A sixth preferred embodiment of an elastic hair clip in the present invention, as shown in FIGS. 13 and 14, includes a main clip frame 1 as the same as that in the fourth embodiment, composed of a first clip frame 10 and a second clip frame 11 and the end 110 of the second clip frame 11 is provided with an auxiliary joint member 3B, which is a through insert hole. A first joint member 2B, which is a stud 23B, is disposed at the end 100 of the first clip frame 10, or at the end 110 of the second clip frame 11 (not shown), and a second joint member 4 separated from the main clip frame 1 is formed with a groove 40 with a lower wall face 41 and an opening 42.

Structured in this way, the open ends 13 of the first and the second clip frame 10 and 11 can be combined together to make the main clip frame 1 curved and maintain elasticity by having the insert hole of the auxiliary joint member 3B combined with the stud 23B of the first joint member 2B and then having the second joint member 4 fitted on the open ends of the first and the second clip frame 10 and 11. The open ends of the first and the second clip frame 10 and 11 can easily be separated when the hair clip is not used, which is thus able to keep the clip frames elastic permanently and insure the service life of the hair clip.

As can be understood from the above description, the joint member and the main clip frame 1 of the hair clip of this invention can be made integrally or separately. Preferably, the joint member and the main clip frame 1 are formed integrally so that the joint member can be prevented from getting lost in the course of use. Of course, it is available to have the joint member and the main clip frame 1 made separately as designed in this invention if the problem of losing the joint member can be overcome. The joint member is provided to combine the first and the second clip frame together when the hair clip is used to make the first and the second clip frame properly curved and maintain elasticity. Thus, the clip frames together with the clip strip can be used to clip hair and the clip frames can always maintain elasticity.

While the preferred embodiments of the invention have been described above, it will be recognized and understood that various modifications may be made therein and the appended claims are intended to cover all such modifications that may fall within the spirit and scope of the invention.

I claim:

1. An elastic hair clip comprising:

a main clip frame composed of a first clip frame and a second clip frame, said first clip frame and said second clip frame respectively having one end integrally formed into a joined end and another end forming an open end, respectively, a clipping strip fixed between said first clip frame and said second clip frame, said clipping strip formed integrally with said joined end of said first and said second clip frame; and a joint member provided for combining together or releasing said open end of said first clip frame and said open end of said second clip frame, wherein said joint member has a groove formed with a lower wall and said groove is bored with an opening, said open end of said first clip frame or said second clip frame is received in said groove of said joint member through said opening to make said clip frame curved.

2. The elastic hair clip as claimed in claim 1, wherein said joint member and said main clip frame are made integrally.

3. The elastic hair clip as claimed in claim 1, wherein said joint member and said main clip frame are processed and secured together after they are made separately.

4. The elastic hair clip as claimed in claim 1, wherein said joint member and said main clip frame are separate in structure.

5. The elastic hair clip as claimed in claim 1, wherein said lower wall of said joint member is formed with a recess.

6. The elastic hair clip as claimed in claim 1, wherein said lower wall of said joint member is bored with a through insert hole.

7. The elastic hair clip as claimed in claim 1, wherein said first clip frame or said second clip frame is provided with an auxiliary joint member.

8. The elastic hair clip as claimed in claim 6, wherein said first clip frame or said second clip frame is provided with an auxiliary joint member formed with an extension face.

9. The elastic hair clip as claimed in claim 6, wherein said first clip frame or said second clip frame is provided with an auxiliary joint member bored with a hole.

10. The elastic hair clip as claimed in claim 1, wherein said first clip frame or said second clip frame is disposed with a stud.

11. An elastic hair clip comprising:

a main clip frame composed of a first clip frame and a second clip frame, said first clip frame and said second clip frame respectively having one end integrally formed into a joined end and another end forming an open end, respectively, a clip strip provided between said first clip frame and said second clip frame, said clip strip having one end integrally formed with said joined end of said first and said second clip frame; and a joint member having a groove formed with a lower wall and said groove being bored with an opening, said joint member functioning to releasably combine said open ends of said first clip frame and said second clip frame.

12. An elastic hair clip comprising:

a main clip frame composed of a first clip frame and a second clip frame, said first clip frame and said second clip frame respectively having one end being integrally formed into a joined end and another end being an open end, respectively, a clip strip fixed between said first clip frame and said second clip frame, said clip strip having one end integrally combined with said joined end of said first and said second clip frame;

a first joint member integrally formed with said first clip frame for releasably combining said open ends of said first clip frame and said second clip frame; and a second joint member provided to be directly fitted on said open ends of said first clip frame and said second clip frame after said open ends are combined by said first joint member, wherein the second joint member has a groove formed with a lower wall and said groove is bored with an opening, and said open ends of said first and said second clip frame are received in said groove of said second joint member through said opening.

* * * * *